US010564593B2

(12) United States Patent
Kojima

(10) Patent No.: US 10,564,593 B2
(45) Date of Patent: Feb. 18, 2020

(54) IMAGE FORMING APPARATUS THAT DETERMINES OPENING OF DOOR

(71) Applicant: CANON KABUSHIKI KAISHA, Tokyo (JP)

(72) Inventor: Yuya Kojima, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/422,792

(22) Filed: May 24, 2019

(65) Prior Publication Data

US 2019/0369549 A1 Dec. 5, 2019

(30) Foreign Application Priority Data

May 30, 2018 (JP) ..... 2018-103910

(51) Int. Cl.

| | |
|---|---|
| ***G03G 15/00*** | (2006.01) |
| ***G03G 21/16*** | (2006.01) |
| ***G03G 15/20*** | (2006.01) |
| ***G03G 15/043*** | (2006.01) |

(52) U.S. Cl.

CPC ..... *G03G 21/1633* (2013.01); *G03G 15/043* (2013.01); *G03G 15/2064* (2013.01); *G03G 15/5004* (2013.01); *G03G 15/6552* (2013.01)

(58) Field of Classification Search

CPC ..... G03G 21/1633; G03G 15/043; G03G 15/2064; G03G 15/5004; G03G 15/6552

See application file for complete search history.

(56) References Cited

U.S. PATENT DOCUMENTS

2010/0061784 A1* 3/2010 Matsushima ..... G03G 15/0935 399/381
2010/0073704 A1* 3/2010 Naruse ..... G03G 15/5004 358/1.14

FOREIGN PATENT DOCUMENTS

| | | | |
|---|---|---|---|
| JP | 2004-20963 | A | 1/2004 |
| JP | 2005-122130 | A | 5/2005 |
| JP | 2006-184329 | A | 7/2006 |
| JP | 2018-005056 | A | 1/2018 |

* cited by examiner

*Primary Examiner* — Hoang X Ngo
(74) *Attorney, Agent, or Firm* — Canon U.S.A. Inc., IP Division

(57) ABSTRACT

An image forming apparatus includes a main body of an apparatus, a door, an image forming unit, a sensor that outputs a predetermined signal when the door is opened, and a control unit that determines that the door is open if the predetermined signal is output from the sensor for a threshold time. When the door is opened, the image forming unit changes to a state where image formation is not executable. The control unit sets a first time as the threshold time, in a period in which the image forming unit contributes to image formation on a recording material. The control unit sets a second time longer than the first time as the threshold time, in a period in which the image forming unit does not contribute to image formation on a recording material or a period in which no image is formed on a recording material.

13 Claims, 9 Drawing Sheets

IMAGE FORMING APPARATUS THAT DETERMINES OPENING OF DOOR

BACKGROUND OF THE INVENTION

Field of the Invention

The present disclosure relates to an image forming apparatus such as a copier or a printer.

Description of the Related Art

An image forming apparatus such as a copier or a printer is provided with a door for replacing a cartridge or removing a jammed recording material. When the door is open, a user can access the inside of a main body of the apparatus. Therefore, it is necessary to stop the operation of a process member provided in the inside of the main body of the apparatus. For this reason, the image forming apparatus is provided with a door sensor for detecting opening of the door. Here, the door sensor outputs a signal, and the voltage value of the signal can change under the influence of noise or chattering.

Japanese Patent Application Laid-Open No. 2004-20963 discusses an image forming apparatus that determines that a door is open, in a case where the voltage value of a signal of a sensor remains unchanged, until a threshold time has elapsed since occurrence of a change in the voltage value of the signal after the door is opened. Such determination is performed to suppress the influence of noise and chattering. For example, the image forming apparatus stops power supply to a fixing heater, immediately after the occurrence of the change in the voltage value of the signal of the sensor, following the opening of the door. However, in a case where the voltage value of the signal returns to the original voltage value before the threshold time elapses after the occurrence of the change in the voltage value of the signal, the image forming apparatus determines that the door is actually not open and resumes the power supply to the fixing heater. This can reduce the possibility that the image forming apparatus erroneously determines the opening of the door under the influence of noise or chattering.

Here, in the image forming apparatus of Japanese Patent Application Laid-Open No. 2004-20963, the length of the threshold time for determining the opening of the door is fixed to a minimum length that can suppress the influence of noise and chattering. Therefore, in a case where a user opens and closes the door by mistake, the image forming apparatus determines that the door is open, because a change in the voltage value of the signal is slower than those due to noise and chattering. In a case where the image forming apparatus erroneously determines the opening of the door during a printing period, print operation is interrupted. In a case where the image forming apparatus erroneously determines the opening of the door during standby, unnecessary return operation occurs after the door is closed.

To prevent the image forming apparatus from determining the opening of the door in the case where the user opens and closes the door by mistake, the threshold time for determining the opening of the door may be increased. However, in a configuration in which a component such as an interlock switch is disposed in an image forming apparatus, and a voltage supplied from a power supply to a specific process member is automatically interrupted when a door is opened, the quality of an image to be formed on a recording material can be affected. For example, in a case where a user opens and closes the door by mistake during image formation by the process member and a voltage supplied to the process member is interrupted, the quality of an image to be formed on a recording material decreases if the image forming apparatus continues print operation without determining the opening of the door.

SUMMARY OF THE INVENTION

According to an aspect of the present disclosure, an image forming apparatus includes a main body of an apparatus, a door configured to expose an inside of the main body, an image forming unit configured to form an image on a recording material, a sensor configured to output a predetermined signal when the door is opened, and a control unit configured to determine that the door is open in a case where the predetermined signal is output from the sensor for a threshold time, and to determine that the door is not open in a case where the predetermined signal is not output from the sensor for the threshold time, wherein when the door is opened, the image forming unit changes to a state where image formation is not executable, and wherein the control unit is configured to set a first time as the threshold time, in a period in which the image forming unit contributes to image formation on a recording material, and the control unit is configured to set a second time longer than the first time as the threshold time, in a period in which the image forming unit does not contribute to image formation on a recording material or a period in which no image is formed on a recording material.

Further features of the present disclosure will become apparent from the following description of exemplary embodiments with reference to the attached drawings.

DESCRIPTION OF THE EMBODIMENTS

[Overall Configuration of Image Forming Apparatus]

Figure 1A:
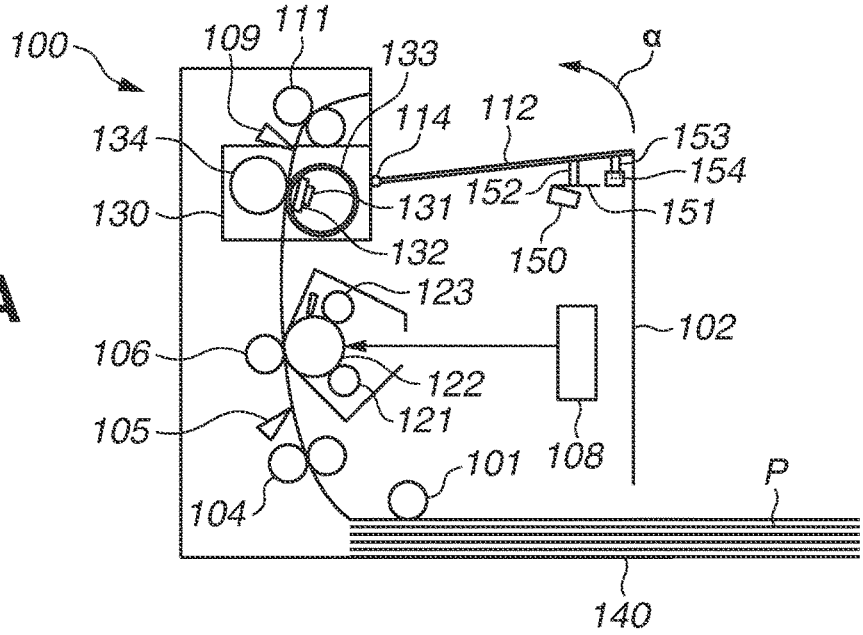
FIGS. 1A, 1B, and 1C each illustrate a schematic configuration of an image forming apparatus.

In a first exemplary embodiment, an electrophotographic laser beam printer 100 (hereinafter referred to as the printer 100) will be described as an image forming apparatus. FIG. 1A is a cross-sectional diagram of the printer 100. FIG. 1A illustrates a photosensitive drum 122 made of an organic photosensitive member or an amorphous silicon photosensitive member. The photosensitive drum 122 is driven to rotate clockwise in FIG. 1A, at a predetermined circumferential velocity (a process speed). The photosensitive drum 122 has a peripheral surface that is uniformly charged by a charging roller 123 to have predetermined polarity and potential. Scanning exposure is performed by being irradiated with a laser beam output from a scanner 108 to the charged surface, so that an electrostatic latent image corresponding to image information is formed. The scanner 108 outputs a laser beam that is modulated (subjected to on/off conversion) in response to a time-series electric digital pixel signal of image information input from an image signal generation apparatus (not illustrated) such as an image reading apparatus or a computer. The printer 100 notifies the image signal generation apparatus of an exposure start timing for a sub-scanning direction, by using a synchronization signal. The electrostatic latent image is thus formed to correspond to a desired image, and a development roller 121 develops the formed electrostatic latent image.

The printer 100 is provided with a sheet feeding tray 140 (a sheet feeding port) in which a sheet P (a recording material) is placed. A sheet feeding roller 101 feeds (sends) the sheet P from the sheet feeding tray 140. Afterward, a registration roller 104 sends the sheet P to the photosensitive drum 122, so that a toner image that is a mirror image of the image on the photosensitive drum 122 is formed on the sheet P. A transfer roller 106 transfers the toner image from the photosensitive drum 122 to the sheet P, by supplying an electric charge opposite in polarity to toner, from the back surface of the sheet P. The sheet P to which the toner image is thus transferred is separated from the photosensitive drum 122, and sent into a fixing device 130, so that the toner image is fixed by heat. The fixing device 130 includes a thermistor 131, a heater 132, a fixing film 133, and a pressurizing roller 134. The sheet P after the fixing by heat is discharged to a sheet discharge tray 112 (a discharge tray) by a discharge roller 111. A top sensor 105 and a fixed sheet discharge sensor 109 are provided on a conveyance path for the sheet P, and each detect a front edge (a downstream edge in a conveyance direction) and a rear edge (an upstream edge in the conveyance direction) of the sheet P.

The sheet discharge tray 112 also functions as a door for exposing the inside of a main body 102 of the apparatus (that may also be referred to as a housing) of the printer 100. The sheet discharge tray 112 is configured to turn about a fulcrum 114 in an arrow-a direction in FIG. 1A. A user can access the inside of the main body 102 of the apparatus, by turning the sheet discharge tray 112. The user can remove the sheet P (that may also be referred to as a jammed paper) remaining on the conveyance path or change a cartridge, by accessing the inside of the main body 102 of the apparatus.

The printer 100 in the present exemplary embodiment further is provided with an interlock switch 150. When the sheet discharge tray 112 is opened with respect to the main body 102 of the apparatus, and the interlock switch 150 is thereby turned off, voltage application to the development roller 121 is automatically interrupted. The sheet discharge tray 112 has an interlock switch protruding portion 152 for pressing down a switch lever 151 of the interlock switch 150.

Further, the printer 100 in the present exemplary embodiment is provided with a door sensor 154 for detecting opening of the sheet discharge tray 112 with respect to the main body 102 of the apparatus. The door sensor 154 is a photo-interruptor, and has a light emitting unit and a light receiving unit that are not illustrated. The sheet discharge tray 112 is provided with a door sensor protruding portion 153 for blocking light between the light emitting unit and the light receiving unit of the door sensor 154. The interlock switch 150 and the door sensor 154 will be described in detail below.

Figure 1B:
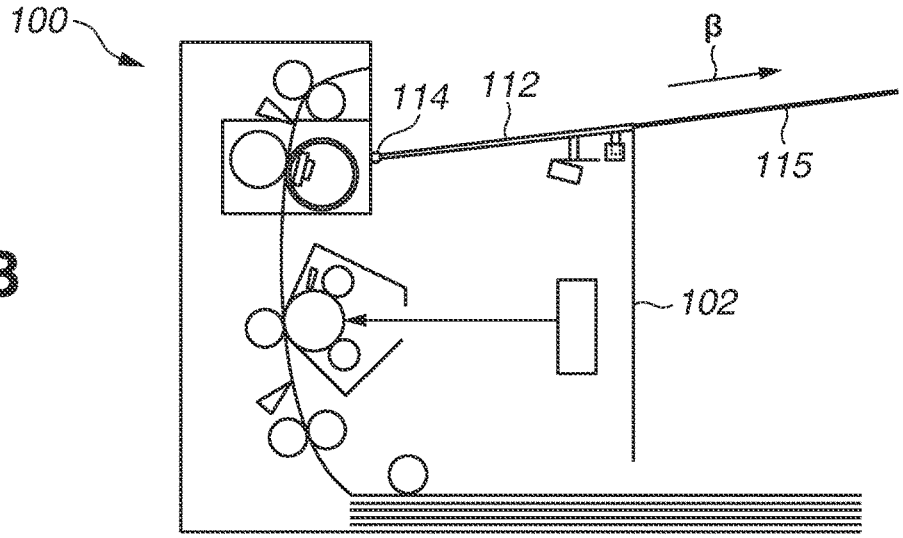

Furthermore, the printer 100 in the present exemplary embodiment has an extension tray 115 for increasing the mounting area of the sheet discharge tray 112. The extension tray 115 is configured to slide between a housed position at which the extension tray 115 is housed in the inside of the printer 100 and a drawn position to which the extension tray 115 is drawn in a direction for discharging the sheet P. The extension tray 115 is at the housed position in FIG. 1A, and at the drawn position in FIG. 1B. As illustrated in FIG. 1B, the extension tray 115 is drawn by the user in an arrow-β direction.

Figure 1C:
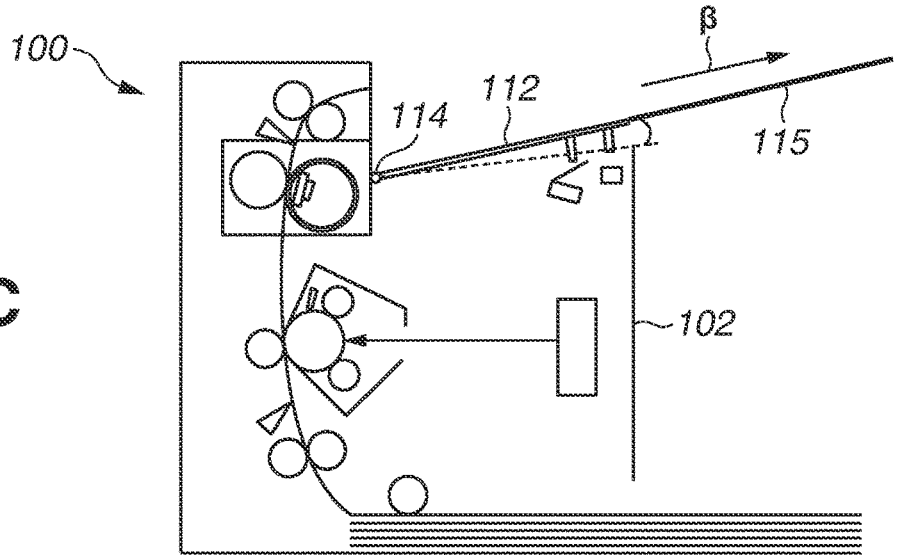

In the apparatus configuration described above, when the user draws out the extension tray 115 from the housed position, a force may be exerted in an upper right oblique direction, so that the user may unintentionally open the sheet discharge tray 112 a small amount, as illustrated in FIG. 1C. The present exemplary embodiment reduces the possibility that the printer 100 determines the opening of the door, in the case where the user thus unintentionally opens the door.

[System Configuration of Image Forming Apparatus]

Figure 2:
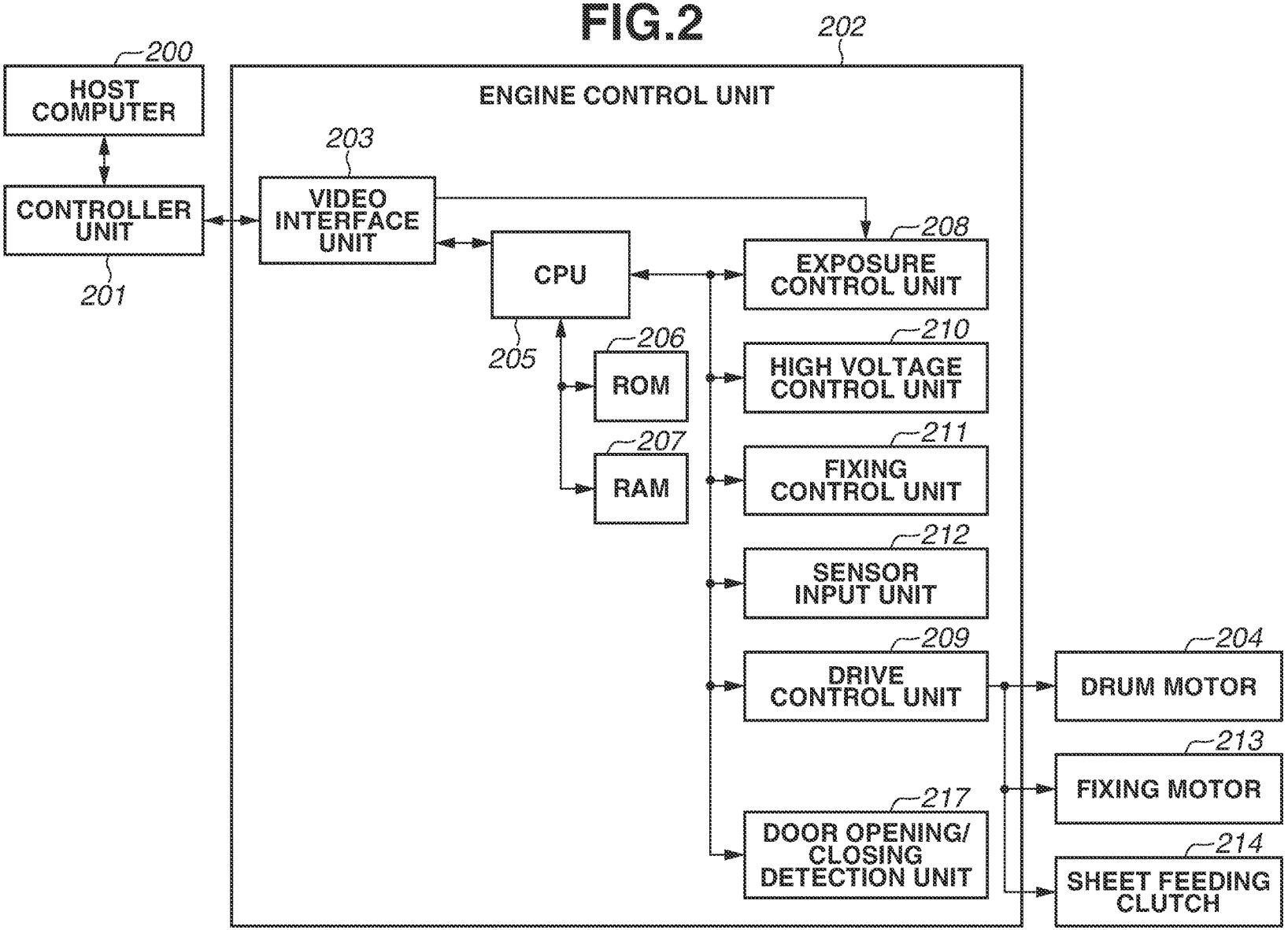
FIG. 2 is a block diagram illustrating a system configuration of the image forming apparatus.

Next, a system configuration of the printer 100 will be described. FIG. 2 is a block diagram illustrating the system configuration of the printer 100. In FIG. 2, the printer 100 includes a controller unit 201 and an engine control unit 202. The controller unit 201 can communicate with a host computer 200 that is an external apparatus, and the engine control unit 202. The engine control unit 202 includes a video interface unit 203, a central processing unit (CPU) 205, an exposure control unit 208, a drive control unit 209, a high voltage control unit 210, a fixing control unit 211, a sensor input unit 212, and a door opening/closing detection unit 217. The CPU 205 is connected to a read only memory (ROM) 206 and a random access memory (RAM) 207. The ROM 206 stores a program and data. The program is executed by the CPU 205 to control the engine control unit 202. The RAM 207 is used for temporary data storage.

The host computer 200 that is the external apparatus transmits print conditions, image data for a print image, and a print command, to the controller unit 201 of the printer 100. The controller unit 201 converts the image data received from the host computer 200 into exposure data necessary for printing by the printer 100, and creates print reservation information for each sheet, based on the received print conditions. Examples of the print reservation information include a sheet feeding port (such as the sheet feeding tray 140) indicating a supply source of the sheet P, the size of the sheet P, and a print mode. The controller unit 201 transmits a print reservation instruction to the CPU 205 via the video interface unit 203, and transmits a print start instruction to the CPU 205 upon completion of the conversion from the image data into the exposure data. Upon receiving the print start instruction from the controller unit 201, the CPU 205 starts print operation.

The drive control unit 209 of the engine control unit 202 drives each roller of the printer 100 to rotate, by using a drum motor 204 or a fixing motor 213. The drum motor 204 drives the sheet feeding roller 101, the registration roller 104, the photosensitive drum 122, and the transfer roller 106 to rotate. The drum motor 204 is connected to the sheet feeding roller 101 via a sheet feeding clutch 214, and drives the sheet feeding roller 101 to rotate by interlocking the sheet feeding clutch 214 for a predetermined time, when the sheet P is fed from the sheet feeding tray 140. The fixing motor 213 drives the pressurizing roller 134 and the discharge roller 111 to rotate.

In response to an instruction from the CPU 205, the exposure control unit 208 rotates a scanning motor (not illustrated) provided in the scanner 108, corrects an exposure amount, and controls emission of a laser beam to the photosensitive drum 122, based on exposure data received from the controller unit 201. The high voltage control unit 210 controls power supply for applying a direct current voltage or an alternating voltage to each of members inside the printer 100, e.g., the charging roller 123, the development roller 121, and the transfer roller 106. The fixing control unit 211 detects a surface temperature of the heater 132 by using the thermistor 131, and controls power supply to the heater 132, based on the result of the detection. The sensor input unit 212 acquires detection information about the top sensor 105 and the fixed sheet discharge sensor 109, and outputs the acquired detection information to the CPU 205. The door opening/closing detection unit 217 acquires detection information about the door sensor 154, and outputs the acquired detection information to the CPU 205.

[Image Forming Operation]

Next, image forming operation of the printer 100 will be described with reference to a timing chart illustrated in FIG. 3. The timing chart illustrates operation of some process members related to the present exemplary embodiment, and a starting point 400 is a start timing for the image forming operation.

When the engine control unit 202 receives an print start instruction from the controller unit 201, the image forming operation begins. First, to prepare for printing, the engine control unit 202 drives the drum motor 204 and the fixing motor 213 (at a timing 401). The charging roller 123 uniformly charges the surface of the photosensitive drum 122.

The engine control unit 202 starts energization of the heater 132 as fixing startup operation (at a timing 402). After the lapse of a predetermined time from the start of the startup for fixing, the engine control unit 202 determines that the preparation for fixing is completed (at a timing 403). At this timing, the engine control unit 202 drives the sheet feeding clutch 214 to feed the sheet P from the sheet feeding tray 140.

In a period 410 in which the sheet P passes the top sensor 105, the engine control unit 202 causes voltage application to the development roller 121 so that toner attaches to an electrostatic latent image formed on the photosensitive drum 122. In other words, the period 410 is a period between detection of the front edge of the sheet P by the top sensor 105 (at a timing 420) and detection of the rear edge of the sheet P by the top sensor 105 (at a timing 421), i.e., a period in which the development roller 121 contributes to image formation on the sheet P.

After a toner image formed on the photosensitive drum 122 is transferred to the sheet P, the sheet P is conveyed to the fixing device 130. The sheet P is nipped at a fixing nip portion formed by the fixing film 133 (a first rotation member) and the pressurizing roller 134 (a second rotation member). In a period 411 in which the sheet P passes the fixing nip portion, the toner image is fixed to the sheet P. In other words, the period 411 is a period from when the front edge of the sheet P enters the fixing nip portion (at a timing 422) to when the rear edge of the sheet P passes the fixing nip portion (at a timing 423). The period 411 is a period in which the fixing device 130 contributes to the image formation on the sheet P.

[Interlock Switch and Door Sensor]

Next, the interlock switch 150 and the door sensor 154 in the present exemplary embodiment will be described in detail.

Figure 4A:
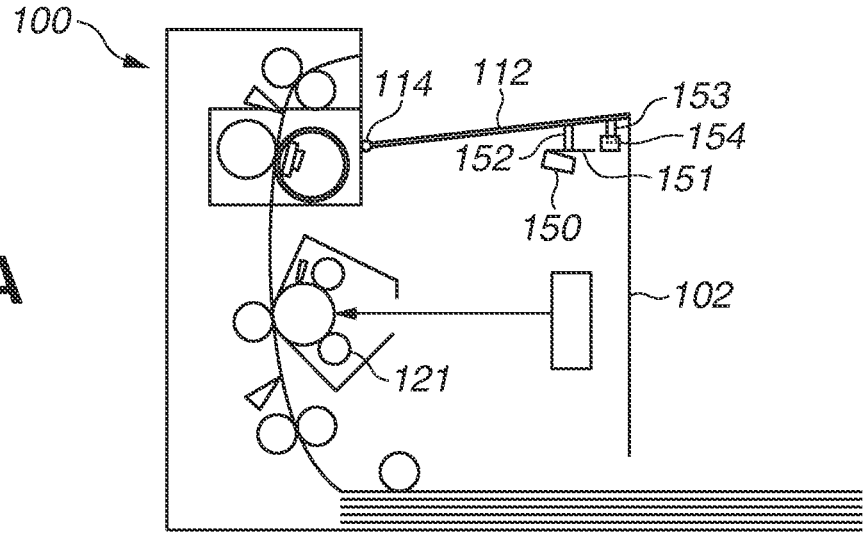
FIGS. 4A, 4B, and 4C each illustrate a state of an interlock switch and a door sensor.

FIG. 4A illustrates a state where the sheet discharge tray 112 is not open. In this state, the interlock switch protruding portion 152 presses down the switch lever 151 and therefore, the interlock switch 150 is in the ON state, and the voltage application to the development roller 121 is enabled. In addition, in this state, the door sensor protruding portion 153 blocks the light between the light emitting unit and the light receiving unit of the door sensor 154 and therefore, the door sensor 154 outputs a LOW signal.

Figure 4B:
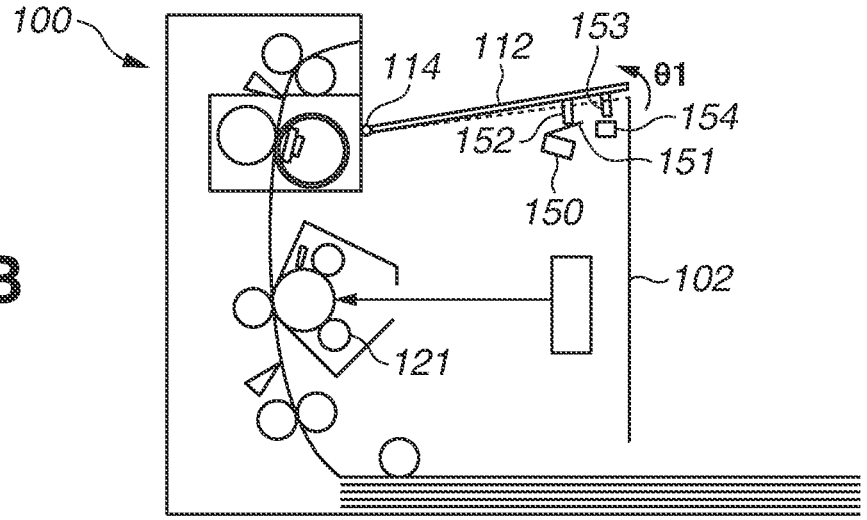

FIG. 4B illustrates a state where the sheet discharge tray 112 is open at an angle θ1 with respect to the main body 102 of the apparatus. In this state, the interlock switch 150 still maintains the ON state, and the voltage application to the development roller 121 is enabled. In addition, in this state, the door sensor protruding portion 153 leaves the position between the light emitting unit and the light receiving unit of the door sensor 154, by moving together with the sheet discharge tray 112 and therefore, the door sensor 154 outputs a HIGH signal (a predetermined signal).

Figure 4C:
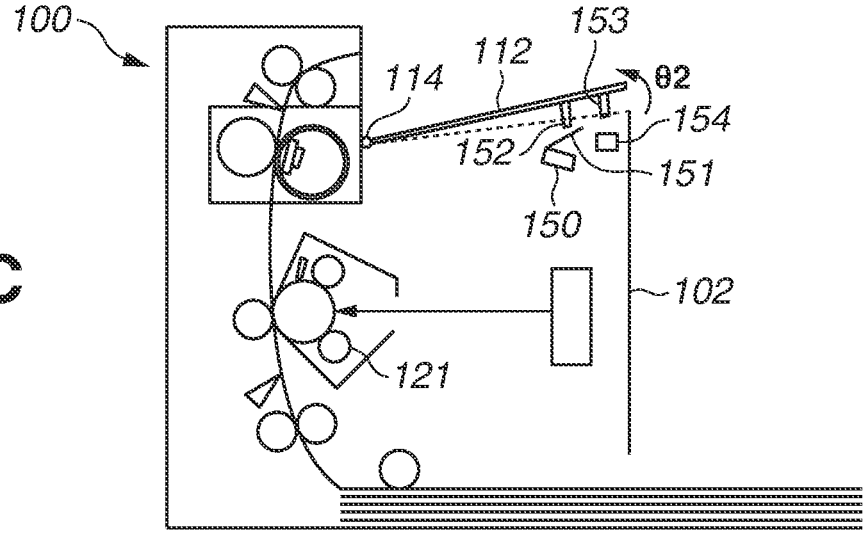

FIG. 4C illustrates a state where the sheet discharge tray 112 is open at an angle θ2 larger than the angle θ1 with respect to the main body 102 of the apparatus, i.e., a state where an opening amount of the sheet discharge tray 112 is large. In this state, the interlock switch protruding portion 152 is separated from the switch lever 151 and therefore, the interlock switch 150 is in the OFF state, and the voltage application to the development roller 121 is disabled. In addition, in this state, the door sensor protruding portion 153 has already left the position between the light emitting unit and the light receiving unit of the door sensor 154 and therefore, the door sensor 154 outputs the HIGH signal.

Here, a time period of at least 30 msec is necessary to bring the interlock switch 150 into the OFF state since output of the HIGH signal by the door sensor 154 after the user starts opening the sheet discharge tray 112. In other words, this is a time period necessary for the printer 100 to shift from the state illustrated in FIG. 4B to the state illustrated in FIG. 4C.

[Door Opening Determination Processing]

Figure 5:
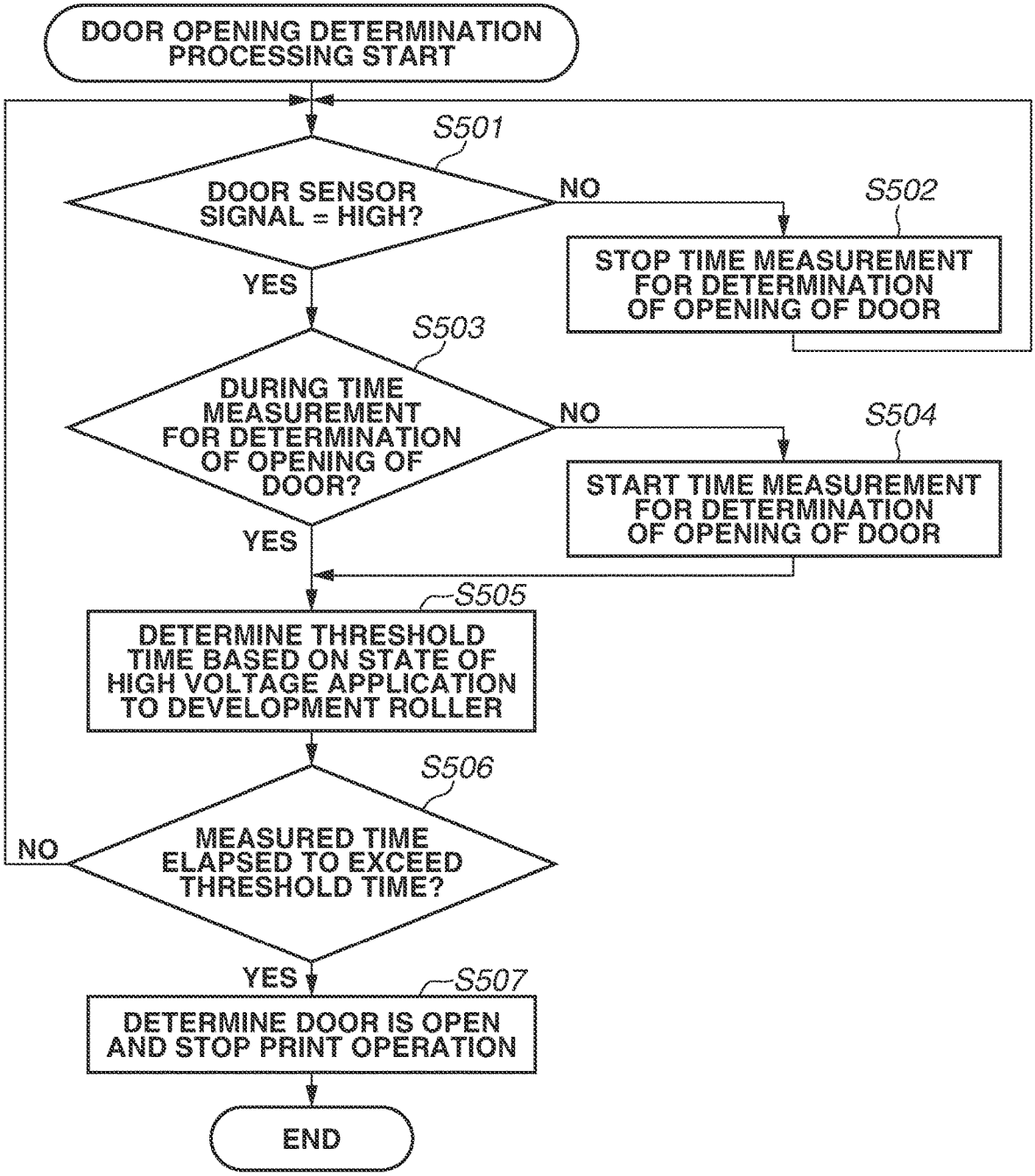
FIG. 5 is a flowchart of door opening determination processing according to a first exemplary embodiment.

FIG. 5 illustrates a flowchart that represents door opening determination processing in the present exemplary embodiment. The engine control unit 202 (the CPU 205) illustrated in FIG. 2 executes control based on the flowchart in FIG. 5, based on a program stored in a memory such as the ROM 206.

The logic of the signal of the door sensor 154 is LOW (closing the door) at the time of the start of the flowchart. In the flowchart thereafter to be described below, the opening of the door is determined, in a case where after the logic of the signal of the door sensor 154 changes from LOW to HIGH (opening the door), and the logic of HIGH continues for a threshold time.

First, in step S501, the engine control unit 202 confirms whether the logic of the signal of the door sensor 154 is HIGH (opening the door). If the logic of the signal of the door sensor 154 is HIGH (YES in step S501), the processing proceeds to step S503. In step S503, the engine control unit 202 determines whether time measurement for the determination of the opening of the door is being performed. The time measurement has not been started at the initial time (NO in step S503), and therefore, the processing proceeds to step S504. In step S504, the engine control unit 202 starts the time measurement. Afterward, in step S505, the engine control unit 202 determines a threshold time for determining the opening of the door, based on whether a high voltage is applied to the development roller 121 by the high voltage control unit 210, with reference to Table 1.

TABLE 1

| Development High Voltage Application State | Threshold Time [msec] |
|---|---|
| Applied | 30 |
| Stopped | 1000 |

Table 1 predefines the threshold time based on a state of high voltage application to the development roller 121. As described above, it takes at least 30 msec before the interlock switch 150 enters the OFF state after the voltage value of the signal of the door sensor 154 changes from LOW to HIGH. Therefore, in the state where the development high voltage is applied, the threshold time for determining the opening of the door needs to be within 30 msec. If a time period longer than 30 msec is set as the threshold time, there is a case where even if the interlock switch 150 enters the OFF state and the development high voltage is stopped during a printing period, the door is not determined to be open and printing continues. This may result in a defective image because of the presence of a section where a toner image is not formed on the photosensitive drum 122. Therefore, in the present exemplary embodiment, the threshold time is 30 msec.

On the other hand, in the state where the development high voltage is stopped, even if the interlock switch 150 enters the OFF state and the development high voltage is stopped, a defective image is not formed even if printing continues, because a toner image is not formed. In this case, an appropriate threshold time for determining the opening of the door is a time period that prevents unnecessary determination of the opening of the door in a case where the user opens and then immediately closes the sheet discharge tray 112 by mistake. Further, an appropriate threshold time for determining the opening of the door is a time period based on which the opening of the door can be determined as quickly as possible in a case where the user undoubtedly opens the sheet discharge tray 112 to access the inside of the main body 102 of the apparatus.

Here, in a case where the user opens and then immediately closes the sheet discharge tray 112 by mistake when drawing the extension tray 115, a time period before the logic of the signal of the door sensor 154 changes from HIGH to be LOW again after the logic changes from LOW to HIGH is, experimentally, about 400 msec. Such time periods vary from user to user. Therefore, in the present exemplary embodiment, 1000 msec is set as the threshold time in consideration of such variations.

Figure 3:
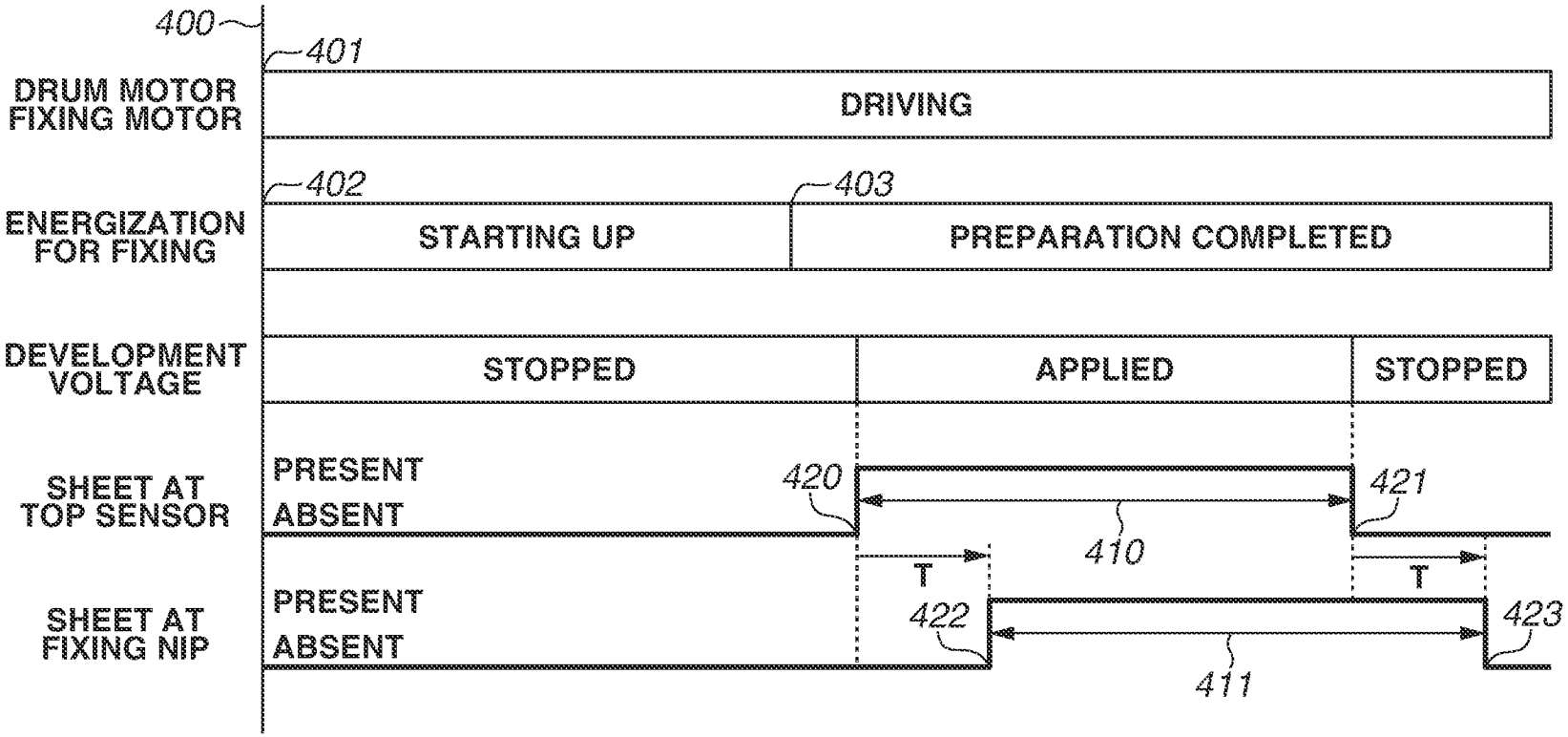
FIG. 3 is a timing chart of image forming operation.

According to the timing chart illustrated in FIG. 3, the engine control unit 202 applies the high voltage to the development roller 121 only in the period 410. Therefore, 30 msec is set as the threshold time in the period 410. In the period except for the period 410, the engine control unit 202 sets 1000 msec as the threshold time. In other words, in the period except for the period 410, the engine control unit 202 continues the print operation without stopping the operation, in a case where the sheet discharge tray 112 is closed and the closing of the door is determined within 1000 msec after the logic of the signal of the door sensor 154 changes from LOW to HIGH.

The description will continue referring back to the flowchart in FIG. 5. In step S506, the engine control unit 202 confirms whether the measured time has elapsed to exceed the threshold time determined in step S505. If the measured time has not elapsed to exceed the threshold time (NO in step S506), the processing returns to step S501 in which the engine control unit 202 confirms the logic of the signal of the door sensor 154 again. If the logic of the signal of the door sensor 154 is HIGH in step S501 (YES in step S501), the engine control unit 202 continues the time measurement. Subsequently, the engine control unit 202 determines the threshold time again based on the application state of the development high voltage in step S505, and then confirms whether the measured time has elapsed to exceed the threshold time in step S506. If the logic of the signal of the door sensor 154 is LOW in step S501 (NO in step S501), the processing proceeds to step S502. In step S502, the engine control unit 202 stops the time measurement, and then performs the confirmation in step S501 again.

If the measured time has elapsed to exceed the threshold time after the above-described processing (YES in step S506), the processing proceeds to step S507. In step S507, the engine control unit 202 determines that the door is open and stops the print operation. Specifically, as the processing in determining that the door is open, the engine control unit 202 immediately stops the operation of each control unit, and stops components such as the drum motor 204 as well. This completes the door opening determination processing.

As described above, in the present exemplary embodiment, in the configuration in which the voltage application to the development roller 121 is automatically interrupted when the interlock switch 150 is turned off, the threshold time for determining the opening of the door is changed based on the state of the voltage application to the development roller 121. This makes it possible to provide an image forming apparatus that avoids a reduction in quality of an image formed on a recording material, by reducing the possibility of determining the opening of a door in a case where a user unintentionally opens and closes the door.

In the present exemplary embodiment, the description is premised on the configuration in which the voltage application to the development roller 121 is automatically interrupted when the interlock switch 150 is turned off. However, the target of the interruption of the voltage application is not limited to the development roller 121. For example, the target may be a process member to which a voltage higher than or equal to a certain threshold is applied in the print operation, specifically, a member such as the charging roller 123 or the transfer roller 106. Furthermore, the target may be the combination of these process members.

In the first exemplary embodiment, there is described the processing for determining the opening of the door in the case where the one process member is inhibited from performing the print operation when the door is open. In a second exemplary embodiment, a method that takes two process members into consideration when setting a threshold time for determining the opening of a door will be described. In the second exemplary embodiment, a point differing from the first exemplary embodiment will be mainly described and a point similar to the first exemplary embodiment will not be described.

[Pressure Release Mechanism of Fixing Device]

The printer 100 in the present exemplary embodiment has a configuration in which the nip pressure between the fixing film 133 and the pressurizing roller 134 included in the fixing device 130 is released when the sheet discharge tray 112 is opened with respect to the main body 102 of the apparatus. The nip pressure release mechanism of the fixing device 130 will be described with reference to FIGS. 6A and 6B.

Figure 6A:
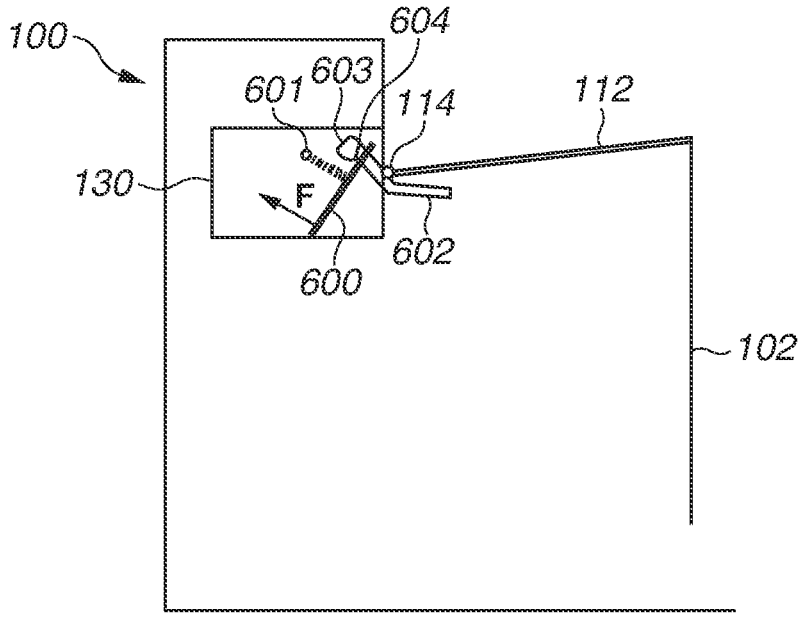
FIGS. 6A and 6B illustrate a pressure release mechanism of a fixing device according to a second exemplary embodiment.
Figure 6B:
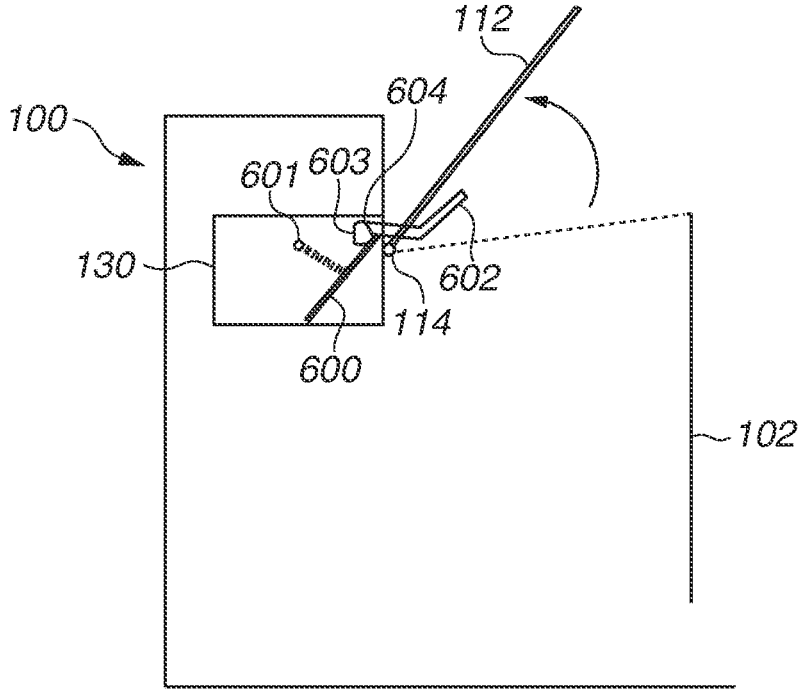

FIGS. 6A and 6B are cross-sectional diagrams of the printer 100 in the present exemplary embodiment, and illustrate components related to the nip pressure release mechanism of the fixing device 130. The interlock switch 150 and the door sensor 154 are provided in the printer 100 as with the first exemplary embodiment, but are omitted in FIGS. 6A and 6B. The fixing device 130 includes a pressurizing plate 600, a pressurizing spring 601, and a pressure release lever 602. The pressurizing spring 601 urges the pressurizing plate 600 in an arrow-F direction. The pressure release lever 602 is configured to turn about a fulcrum 604 together with the sheet discharge tray 112, and includes a cam portion 603 for lifting the pressurizing plate 600.

As illustrated in FIG. 6A, in a state where the sheet discharge tray 112 is closed, the cam portion 603 included in the pressure release lever 602 is not in contact with the pressurizing plate 600, and the fixing film 133 and the pressurizing roller 134 are nipped by a strong force due to a pressure exerted by the pressurizing plate 600. As illustrated in FIG. 6B, in a state where the sheet discharge tray 112 is open, the cam portion 603 included in the pressure release lever 602 is in contact with the pressurizing plate 600, and the pressure exerted by the pressurizing plate 600 is released, so that the fixing film 133 and the pressurizing roller 134 are in a pressure release state.

The nip pressure between the fixing film 133 and the pressurizing roller 134 weakens when the sheet discharge tray 112 is opened at an opening angle of about 30 degrees from the state where the sheet discharge tray 112 is closed, and the pressure release state begins at an opening angle of about 45 degrees. It takes at least 450 msec before the nip pressure between the fixing film 133 and the pressurizing roller 134 begins to weaken (is released), after the logic of the signal of the door sensor 154 changes from LOW to HIGH upon the start of the opening of the sheet discharge tray 112 by the user.

[Door Opening Determination Processing]

Figure 7:
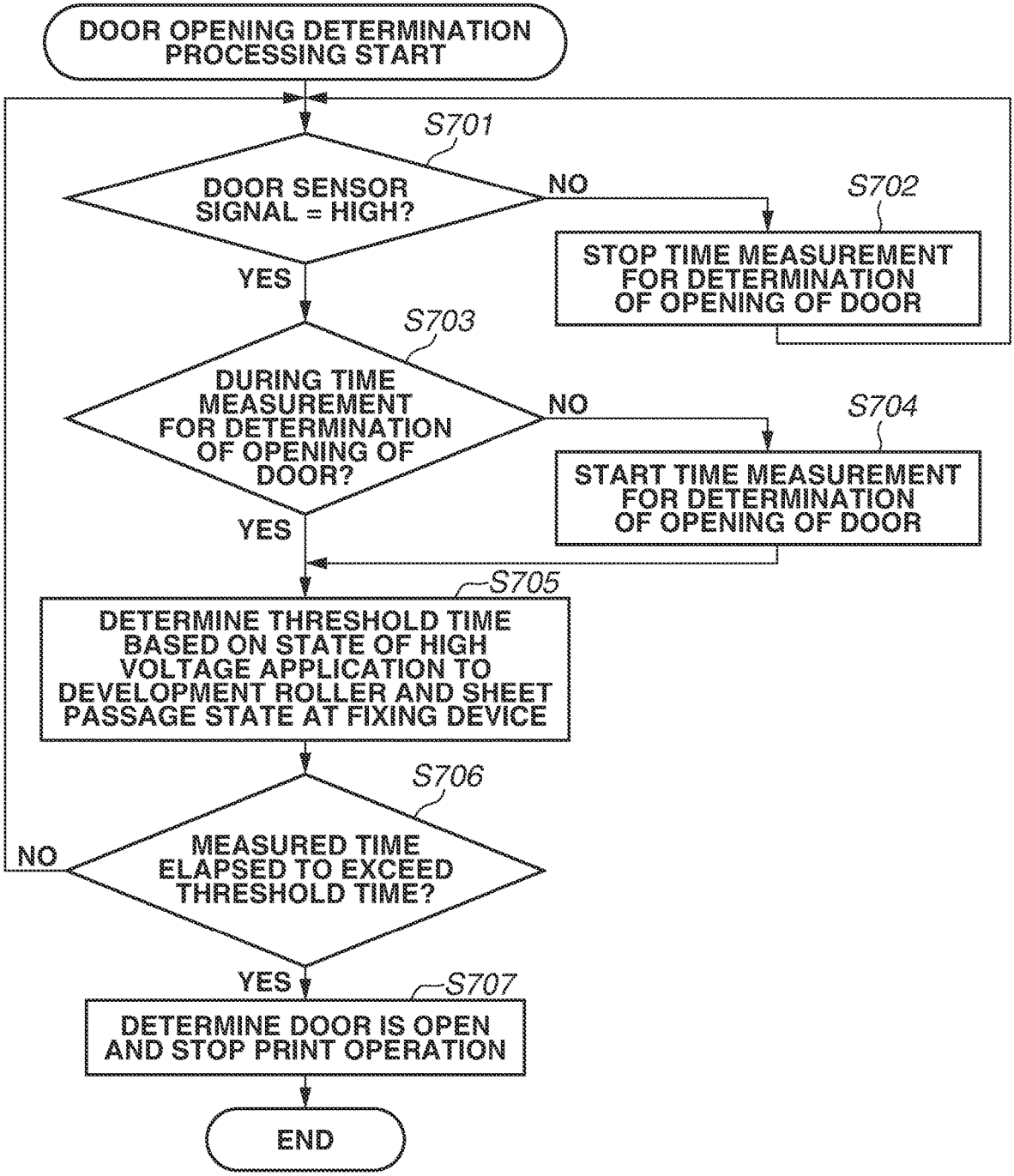
FIG. 7 is a flowchart of door opening determination processing according to the second exemplary embodiment.

FIG. 7 illustrates a flowchart that represents door opening determination processing in the present exemplary embodiment. The engine control unit 202 (the CPU 205) illustrated in FIG. 2 executes control based on the flowchart in FIG. 7, based on a program stored in a memory such as the ROM 206.

The logic of the signal of the door sensor 154 is LOW (closing the door) at the time of the start of the flowchart. In the flowchart thereafter to be described below, the opening of the door is determined, in a case where after the logic of the signal of the door sensor 154 changes from LOW to HIGH (opening the door), the logic of HIGH continues for a threshold time.

First, in step S701, the engine control unit 202 confirms whether the logic of the signal of the door sensor 154 is HIGH (opening the door). If the logic of the signal of the door sensor 154 is HIGH (YES in step S701), the processing proceeds to step S703. In step S703, the engine control unit 202 determines whether time measurement for the determination of the opening of the door is being performed. The time measurement has not started at the initial time (NO in step S703), and therefore, the processing proceeds to step S704. In step S704, the engine control unit 202 starts the time measurement. Afterward, in step S705, the engine control unit 202 determines a threshold time for determining the opening of the door, based on whether a high voltage is applied to the development roller 121 by the high voltage control unit 210, and whether the sheet P is nipped at the fixing device 130, with reference to Table 2.

TABLE 2

| Development High Voltage Application State | Sheet Inside Fixing Device | Threshold Time [msec] |
|---|---|---|
| Applied | Absent | 30 |
| Applied | Present | 30 |
| Stopped | Absent | 1000 |
| Stopped | Present | 450 |

Table 2 predefines the threshold time based on the combination of the state of the high voltage application to the development roller 121, and whether the sheet P is nipped at the fixing device 130. In a case where the sheet P is nipped at the fixing device 130, the sheet P is not conveyed normally or a toner image is not sufficiently fixed, if the sheet discharge tray 112 is opened and the nip pressure of the fixing device 130 is released. In this case, a defective image can be formed. Therefore, if the pressure is released in a case where the sheet P is nipped at the fixing device 130, it is necessary to stop print operation.

As described above, it takes at least 450 msec before the nip pressure of the fixing device 130 begins to weaken, after the logic of the signal of the door sensor 154 changes from LOW to HIGH. Therefore, in a case where the sheet P is nipped at the fixing device 130, the threshold time for determining the opening of the door needs to be within 450 msec. In the present exemplary embodiment, the threshold time is 450 msec.

A method in which the engine control unit 202 determines whether the sheet P is nipped at the fixing device 130 will be described with reference to FIG. 3. The engine control unit 202 determines that a sheet is present at the fixing nip portion, at the timing (the timing 422) at which the time period T has elapsed since a starting point that is the timing (the timing 420) at which the top sensor 105 detects the front edge of the sheet P. The time period T is a time period necessary for conveyance of the sheet P from the top sensor 105 to the fixing device 130. Similarly, the engine control unit 202 determines that no sheet is present at the fixing nip portion, at the timing (the timing 423) at which the time period T has elapsed since a starting point that is the timing (the timing 421) at which the top sensor 105 detects the rear edge of the sheet P. In other words, the engine control unit 202 determines that the sheet P is nipped at the fixing device 130 in the period 411.

Based on the above description, Table 2 is provided to adopt one of a threshold time determined based on the state of the high voltage application to the development roller 121, and a threshold time determined based on whether the sheet P is nipped at the fixing device 130, whichever is shorter.

The description will continue referring back to the flowchart in FIG. 7. In step S706, the engine control unit 202 confirms whether the measured time has elapsed to exceed the threshold time determined in step S705. If the measured time has not elapsed to exceed the threshold time (NO in step S706), the processing returns to step S701 in which the engine control unit 202 confirms the logic of the signal of the door sensor 154 again. If the logic of the signal of the door sensor 154 is HIGH in step S701 (YES in step S701), the engine control unit 202 continues the time measurement. Subsequently, the engine control unit 202 determines the threshold time again, based on the application state of the development high voltage and the state of the sheet P nipped at the fixing device 130 in step S705, and then confirms whether the measured time has elapsed to exceed the threshold time in step S706. If the logic of the signal of the door sensor 154 is LOW in step S701 (NO in step S701), the processing proceeds to step S702. In step S702, the engine control unit 202 stops the time measurement, and then performs the confirmation in step S701 again.

If the measured time has elapsed to exceed the threshold time after the above-described processing (YES in step S706), the processing proceeds to step S707. In step S707, the engine control unit 202 determines that the door is open and stops the print operation. Specifically, as the processing in determining that the door is open, the engine control unit 202 immediately stops the operation of each control unit, and stops components such as the drum motor 204 as well. This completes the door opening determination processing.

In the present exemplary embodiment, the description is premised on the configuration in which the voltage application to the development roller 121 is automatically interrupted when the interlock switch 150 is turned off, as with the first exemplary embodiment. However, the present exemplary embodiment is not limited to the configuration. There may be adopted such a configuration that the interlock switch 150 is not provided, and only the nip pressure of the fixing device 130 is released when the sheet discharge tray 112 is opened. In this case, the engine control unit 202 sets 450 msec as the threshold time in the period 411, and sets 1000 msec as the threshold time in the period except for the period 411.

As described above, in the present exemplary embodiment, in the configuration in which the nip pressure of the fixing device 130 is released when the sheet discharge tray 112 is opened, the threshold time for determining the opening of the door is changed based on the state of the sheet P nipped at the fixing device 130. This makes it possible to provide an image forming apparatus that avoids a reduction in quality of an image formed on a recording material, by reducing the possibility of determining the opening of a door in a case where a user unintentionally opens and closes the door.

In a third exemplary embodiment, the controller unit 201 notifies the engine control unit 202 of an output start timing and an output end timing for exposure data page by page, during a printing period. A method for determining a threshold time for determining the opening of a door based on these pieces of information will be described. In the third exemplary embodiment, a point differing from the first exemplary embodiment will be mainly described and a point similar to the first exemplary embodiment will not be described.

[Notification of Exposure Data Output Timing]

Figure 8:
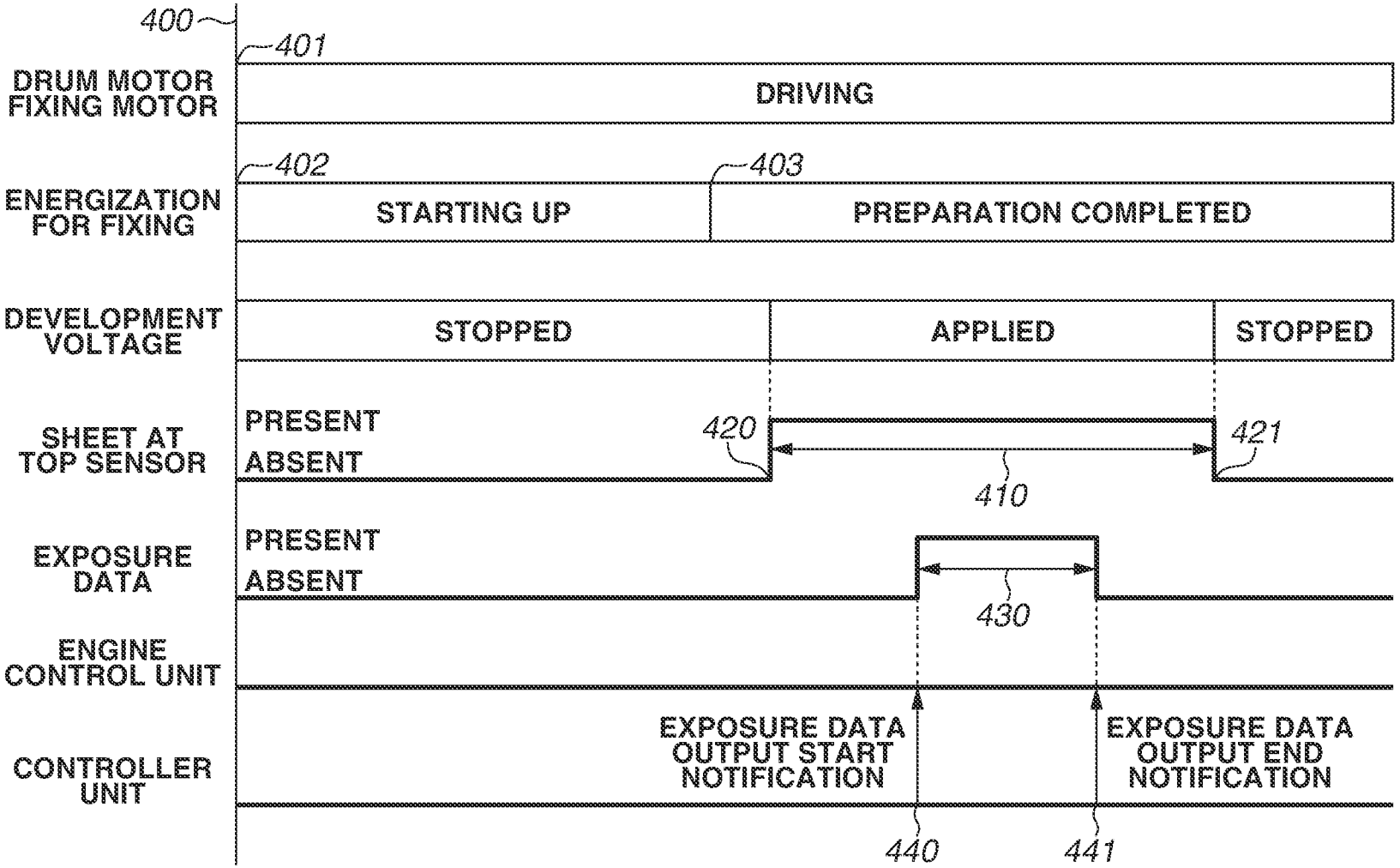
FIG. 8 is a timing chart of image forming operation according to a third exemplary embodiment.

FIG. 8 is a timing chart formed by adding a state of exposure data output from the controller unit 201 to the engine control unit 202, to the timing chart of the image forming operation illustrated in FIG. 3. Contents similar to FIG. 3 will not be described. After the engine control unit 202 outputs an exposure data start signal (a synchronization signal) to the controller unit 201, the controller unit 201 starts outputting exposure data to the engine control unit 202. At this timing (a timing 440), the controller unit 201 transmits an exposure data output start notification to the engine control unit 202. Subsequently, at a timing (at a timing 441) at which the output of the exposure data of a page in processing ends, the controller unit 201 transmits an exposure data output end notification to the engine control unit 202. In other words, a period 430 represents a period in which a toner image can be formed on the photosensitive drum 122.

[Door Opening Determination Processing]

Figure 9:
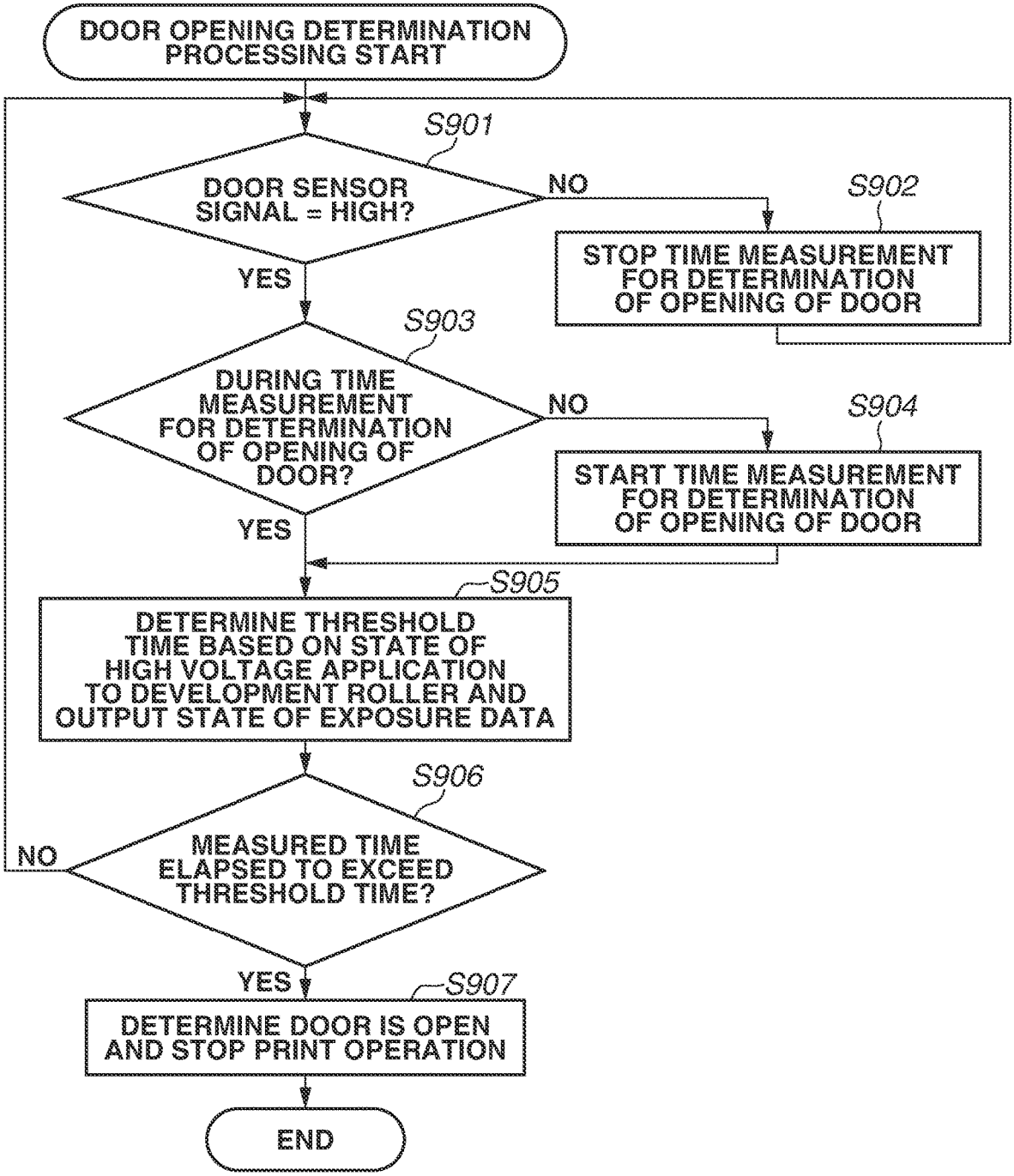
FIG. 9 is a flowchart of door opening determination processing according to the third exemplary embodiment.

FIG. 9 illustrates a flowchart that represents door opening determination processing in the present exemplary embodiment. The engine control unit 202 (the CPU 205) illustrated in FIG. 2 executes control based on the flowchart in FIG. 9, based on a program stored in a memory such as the ROM 206.

The logic of a signal of the door sensor 154 is LOW (closing the door) at the time of the start of this flowchart. In the flowchart thereafter to be described below, the opening of the door is determined, in a case where after the logic of the signal of the door sensor 154 changes from LOW to HIGH (opening the door), the logic of HIGH continues for a threshold time.

First, in step S901, the engine control unit 202 confirms whether the logic of the signal of the door sensor 154 is HIGH (opening the door). If the logic of the signal of the door sensor 154 is HIGH (YES in step S901), the processing proceeds to step S903. In step S903, the engine control unit 202 determines whether time measurement for the determination of the opening of the door is being performed. The time measurement has not started at the initial time (NO in step S903), and therefore, the processing proceeds to step S904. In step S904, the engine control unit 202 starts the time measurement. Afterward, in step S905, the engine control unit 202 determines a threshold time for determining the opening of the door, based on whether a high voltage is applied to the development roller 121 by the high voltage control unit 210, and whether exposure data is being output by the controller unit 201, with reference to Table 3.

TABLE 3

| Development High Voltage Application State | Exposure Data | Threshold Time [msec] |
|---|---|---|
| Applied | Present | 30 |
| Applied | Absent | 1000 |
| Stopped | Absent | 1000 |

Table 3 predefines the threshold time based on the combination of the state of the high voltage application to the development roller 121, and whether the exposure data is being output by the controller unit 201. In the first exemplary embodiment, in the state where the development high voltage is applied, the time period before the interlock switch 150 enters the OFF state is 30 msec. Even if the interlock switch 150 enters the OFF state and the voltage supply to the development roller 121 is interrupted, no toner image is formed on the photosensitive drum 122 and thus a defective image is not formed, if exposure data is not output by the controller unit 201. Therefore, it is not necessary to determine the opening of the door based on the threshold time of 30 msec. In the present exemplary embodiment, 1000 msec is set as the threshold time in a period in which exposure data is not output by the controller unit 201, as with the period in which the application of the development high voltage is stopped in the first exemplary embodiment.

The description will continue referring back to the flowchart in FIG. 9. In step S906, the engine control unit 202 confirms whether the measured time has elapsed to exceed the threshold time determined in step S905. If the measured time has not elapsed to exceed the threshold time (NO in step S906), the processing returns to step S901 in which the engine control unit 202 confirms the logic of the signal of the door sensor 154 again. If the logic of the signal of the door sensor 154 is HIGH in step S901 (YES in step S901), the engine control unit 202 continues the time measurement.

Subsequently, the engine control unit 202 determines the threshold time again, based on the application state of the development high voltage and the output state of the exposure data in step S905, and then confirms whether the measured time has elapsed to exceed the threshold time in step S906. If the logic of the signal of the door sensor 154 is LOW in step S901 (NO in step S901), the processing proceeds to step S902. In step S902, the engine control unit 202 stops the time measurement, and then performs the confirmation in step S901 again.

If the measured time has elapsed to exceed the threshold time after the above-described processing (YES in step S906), the processing proceeds to step S907. In step S907, the engine control unit 202 determines that the door is open and stops the print operation. Specifically, as the processing in determining that the door is open, the engine control unit 202 immediately stops the operation of each control unit, and stops components such as the drum motor 204 as well. This completes the door opening determination processing.

In the present exemplary embodiment, a time period before an electrostatic latent image formed by the scanner 108 moves to a position facing the development roller 121 is not taken into consideration, but the threshold time may be set by taking this time period into consideration. In other words, even in a period in which the scanner 108 outputs exposure data, a toner image is not formed on the photosensitive drum 122 if the electrostatic latent image has not moved to the position facing the development roller 121. Therefore, 1000 msec may be set as the threshold time.

As described above, in the present exemplary embodiment, in the configuration in which the voltage application to the development roller 121 is automatically interrupted when the interlock switch 150 is turned off, the threshold time is changed based on the state of the voltage application to the development roller 121 and the output state of the exposure data. This makes it possible to provide an image forming apparatus that avoids a reduction in quality of an image formed on a recording material, by reducing the possibility of determining the opening of a door in a case where a user unintentionally opens and closes the door.

In each of the first to third exemplary embodiments described above, the extension tray 115 is configured to slide from the housed position to the drawn position, but is not limited to this configuration. The extension tray 115 may be configured to turn to be movable between a position at which the extension tray 115 is extended and a position at which the extension tray 115 is not extended, with respect to the sheet discharge tray 112 in a direction for discharging the sheet P. Further, the extension tray 115 may be configured to be detachably attached to the printer 100. Furthermore, a configuration in which the printer 100 is not provided with the extension tray 115 may be adopted.

In each of the first to third exemplary embodiments described above, the laser beam printer is described as an example. However, an image forming apparatus to which the present disclosure is applied is not limited to this example, and may be a printer of another printing type such as an inkjet printer, or a copier.

According to the present exemplary embodiments, it possible to provide an image forming apparatus that avoids a reduction in quality of an image formed on a recording material, by reducing the possibility of determining the opening of a door in a case where a user unintentionally opens and closes the door.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-103910, filed May 30, 2018, which is hereby incorporated by reference herein in its entirety.

What is claimed is:

1. An image forming apparatus comprising:

a main body of an apparatus;

a door configured to expose an inside of the main body;

an image forming unit configured to form an image on a recording material;

a sensor configured to output a predetermined signal when the door is opened; and a control unit configured to determine that the door is open in a case where the predetermined signal is output from the sensor for a threshold time, and to determine that the door is not open in a case where the predetermined signal is not output from the sensor for the threshold time, wherein when the door is opened, the image forming unit changes to a state where image formation is not executable, and wherein the control unit is configured to set a first time as the threshold time, in a period in which the image forming unit contributes to image formation on a recording material, and the control unit is configured to set a second time longer than the first time as the threshold time, in a period in which the image forming unit does not contribute to image formation on a recording material or a period in which no image is formed on a recording material.

2. The image forming apparatus according to claim 1, wherein the image forming unit includes a development unit that develops a toner image on a photosensitive member, and wherein when the door is opened, a voltage supplied from a power supply to the development unit is interrupted.

3. The image forming apparatus according to claim 2, wherein a period in which the development unit contributes to image formation on a recording material is a period in which a voltage is applied to the development unit to develop a toner image on the photosensitive member, and wherein a period in which the development unit does not contribute to image formation on a recording material or a period in which no image is formed on a recording material is a period in which no voltage is applied to the development unit.

4. The image forming apparatus according to claim 2, wherein the image forming unit includes an exposure unit that emits light to a charged photosensitive member and forms an electrostatic latent image on the photosensitive member, and wherein the control unit is configured to set the first time as the threshold time, in a period in which the development unit and the exposure unit contribute to image formation on a recording material, and the control unit is configured to set the second time as the threshold time, in a period in which the development unit contributes to and the exposure unit does not contribute to image formation on a recording material, a period in which the development unit and the exposure unit do not contribute to image formation on a recording material, or a period in which no image is formed on a recording material.

5. The image forming apparatus according to claim 4, wherein the period in which the development unit and the exposure unit contribute to image formation on a recording material is a period in which an electrostatic latent image formed on the photosensitive member by the exposure unit is at a position facing the development unit, and a voltage is applied to the development unit to develop a toner image on the photosensitive member, wherein the period in which the development unit contributes to and the exposure unit does not contribute to image formation on a recording material is a period in which an electrostatic latent image formed on the photosensitive member by the exposure unit is not at a position facing the development unit, and a voltage is applied to the development unit, and wherein the period in which the development unit and the exposure unit do not contribute to image formation on a recording material or the period in which no image is formed on a recording material is a period in which an electrostatic latent image formed on the photosensitive member by the exposure unit is not at a position facing the development unit, or no electrostatic latent image is formed on the photosensitive member, and no voltage is applied to the development unit.

6. The image forming apparatus according to claim 1, wherein the image forming unit includes a fixing unit that fixes a toner image to a recording material, and wherein the fixing unit includes a first rotation member, and a second rotation member that forms a nip portion with the first rotation member, the fixing unit configured to fix a toner image to a recording material in a state where the recording material is nipped at the nip portion, and a nip pressure exerted by the first rotation member and the second rotation member decreases when the door is opened.

7. The image forming apparatus according to claim 6, wherein a period in which the fixing unit contributes to image formation on a recording material is a period in which a recording material is nipped at the nip portion, and wherein a period in which the fixing unit does not contribute to image formation on a recording material or a period in which no image is formed on a recording material is a period in which a recording material is not nipped at the nip portion.

8. The image forming apparatus according to claim 1, wherein an opening amount of the door for change of the image forming unit to a state where image formation is not executable is larger than an opening amount of the door for output of the predetermined signal by the sensor.

9. The image forming apparatus according to claim 1, further comprising:

a discharge tray configured to discharge a recording material on which an image is formed; and an extension tray configured to move between a first position at which the extension tray is extended with respect to the discharge tray and a second position at which the extension tray is not extended with respect to the discharge tray, in a direction for discharging a recording material.

10. The image forming apparatus according to claim 9, wherein the extension tray is housed in the main body at the second position, and slidable from the second position to the first position at which the extension tray is drawn to an outside of the main body.

11. An image forming apparatus comprising:

a main body of an apparatus;

a door configured to expose an inside of the main body;

a first image forming unit configured to form an image on a recording material;

a second image forming unit configured to form an image on a recording material;

a sensor configured to output a predetermined signal when the door is opened; and a control unit configured to stop the second image forming unit in a case where the predetermined signal is output from the sensor for a threshold time, and not to stop the second image forming unit in a case where the predetermined signal is not output from the sensor for the threshold time, during image formation on a recording material, wherein when the door is opened, the first image forming unit changes to a state where image formation is not executable, and wherein the control unit is configured to set a first time as the threshold time, in a period in which the first image forming unit contributes to image formation on a recording material, and the control unit is configured to set a second time longer than the first time as the threshold time, in a period in which the first image forming unit does not contribute to image formation on a recording material.

12. The image forming apparatus according to claim 11, further comprising:

a discharge tray configured to discharge a recording material on which an image is formed; and an extension tray configured to move between a first position at which the extension tray is extended with respect to the discharge tray and a second position at which the extension tray is not extended with respect to the discharge tray, in a direction for discharging a recording material.

13. The image forming apparatus according to claim 12, wherein the extension tray is housed in the main body at the second position, and slidable from the second position to the first position at which the extension tray is drawn to an outside of the main body.

* * * * *